US010720087B2

(12) United States Patent
Phuklin Prichystal

(10) Patent No.: US 10,720,087 B2
(45) Date of Patent: Jul. 21, 2020

(54) ILLUMINATED PATTERNS ON A SURFACE

(71) Applicant: Bang & Olufsen A/S, Struer (DK)

(72) Inventor: Jan Phuklin Prichystal, Struer (DK)

(73) Assignee: BANG & OLUFSEN A/S, Struer (DK)

( * ) Notice: Subject to any disclaimer, the term of this patent is extended or adjusted under 35 U.S.C. 154(b) by 163 days.

(21) Appl. No.: 15/103,786

(22) PCT Filed: Dec. 12, 2014

(86) PCT No.: PCT/DK2014/050428
§ 371 (c)(1),
(2) Date: Jun. 10, 2016

(87) PCT Pub. No.: WO2015/086032
PCT Pub. Date: Jun. 18, 2015

(65) Prior Publication Data

US 2016/0321965 A1 Nov. 3, 2016

(30) Foreign Application Priority Data

Dec. 13, 2013 (DK) ..... 2013 00688

(51) Int. Cl.

| | |
|---|---|
| ***G09F 13/06*** | (2006.01) |
| ***B44C 1/22*** | (2006.01) |
| ***B44C 3/10*** | (2006.01) |
| ***C25D 11/16*** | (2006.01) |
| ***C25D 11/18*** | (2006.01) |
| ***C25D 11/24*** | (2006.01) |

(52) U.S. Cl.
CPC ..... *G09F 13/06* (2013.01); *B44C 1/228* (2013.01); *B44C 3/10* (2013.01); *C25D 11/16* (2013.01); *C25D 11/18* (2013.01); *C25D 11/243* (2013.01); *C25D 11/246* (2013.01)

(58) Field of Classification Search
CPC ..... G09F 13/06; C25D 11/246; C25D 11/18; C25D 11/16; B44C 3/10; B44C 1/228
See application file for complete search history.

(56) References Cited

U.S. PATENT DOCUMENTS

| | | | |
|---|---|---|---|
| 2,812,295 | A | 11/1957 | Patrick |
| 7,880,131 | B2 | 2/2011 | Andre et al. |
| 2009/0040790 | A1 | 2/2009 | Payne |

(Continued)

FOREIGN PATENT DOCUMENTS

| | | |
|---|---|---|
| WO | 2011/002617 A1 | 1/2011 |

OTHER PUBLICATIONS

PCT/DK2014/050428, European Patent Office, International Search Report, dated Mar. 25, 2015.

(Continued)

*Primary Examiner* — Louis J Rufo
(74) *Attorney, Agent, or Firm* — Ice Miller LLP

(57) ABSTRACT

The present invention relates to a method to configure an illuminated surface on a device, and to generate illuminated patterns on a hard surface and to disclose an embodiment in an apparatus that applies the invention. The graphical patterns may include text and/or symbols as illuminated surfaces on the device. The invention may be used in all types of equipment and apparatus, where there is a demand for a high quality user interaction surfaces including graphics patterns on the surface, with a very nice looking expression/display.

2 Claims, 6 Drawing Sheets

(56) References Cited

U.S. PATENT DOCUMENTS

Figure 2:
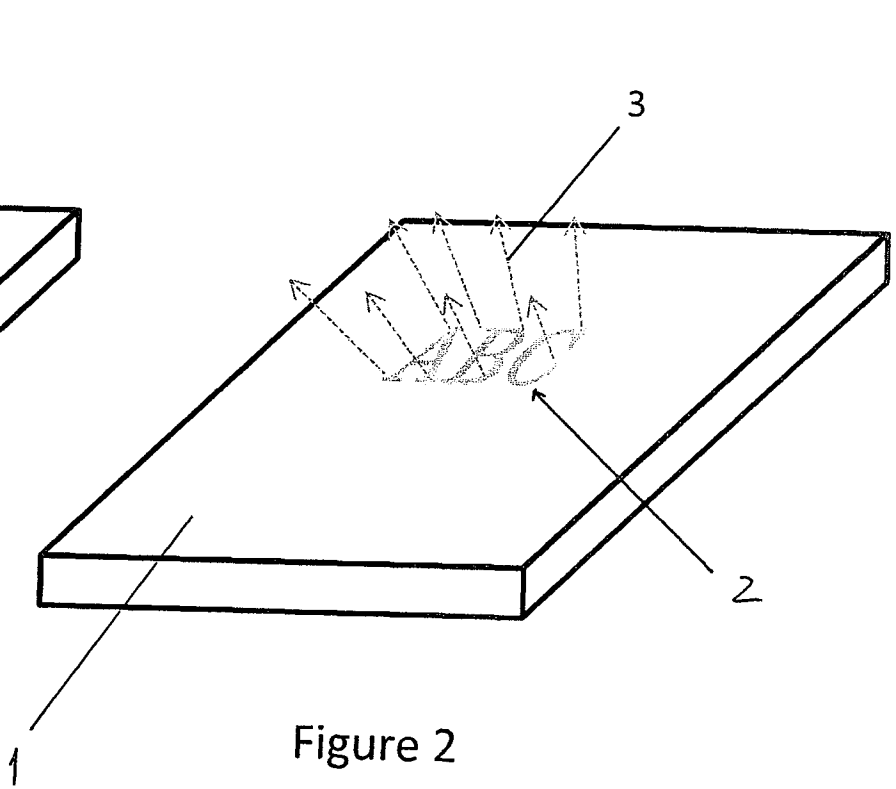

| | | | | |
|---|---|---|---|---|
| 2010/0008030 | A1* | 1/2010 | Weber | C25D 11/16 361/679.02 |
| 2010/0215926 | A1* | 8/2010 | Askin | C25D 11/18 428/209 |
| 2011/0017602 | A1* | 1/2011 | Khosla | C25D 5/02 205/50 |
| 2011/0089067 | A1 | 4/2011 | Scott et al. | |
| 2011/0236645 | A1* | 9/2011 | Osako | F21S 2/00 428/195.1 |
| 2013/0147715 | A1 | 6/2013 | Nakamura | |
| 2014/0061054 | A1* | 3/2014 | Ye | C25D 11/243 205/112 |
| 2016/0294002 | A1* | 10/2016 | Matsuura | H01G 11/68 |

OTHER PUBLICATIONS

PCT/DK2014/050428, European Patent Office, Written Opinion of the International Searching Authority, dated Mar. 25, 2015.

* cited by examiner

ILLUMINATED PATTERNS ON A SURFACE

CROSS-REFERENCE TO RELATED APPLICATIONS

The present application is a U.S. national stage of, and claims the priority benefit of, International Patent Application Serial No. PCT/DK2014/050428, filed Dec. 12, 2014 and Denmark Patent Application Serial No. PA 2013 00688, filed Dec. 13, 2013, the text and drawings of which are hereby incorporated by reference in their entireties.

FIELD OF THE INVENTION

The present invention relates to a method to configure a surface on a device, and to generate illuminated patterns on a hard surface, e.g. metal and an apparatus having such a configured surface.

BACKGROUND OF THE INVENTION

In the art it is well-known to process and anodize Aluminum surfaces to obtain decorative effects this e.g. being translucent aluminum surfaces as disclosed by Bang & Olufsen a/s in U.S. Pat. No. 7,334,362 and by Apple Inc. in U.S. Pat. No. 7,880,131.

There is a demand for more and more advanced graphical surfaces on consumer products, this to add new functionality and differentiate one company's products from a competitor's products.

For the decorative aspects of the surface it is important that the final processing is well defined and fully controlled within specific premises. With the hightech technology tools that are available in the process industry it has become possible and feasible to apply these technologies in manufacturing of consumer goods.

OBJECT OF THE INVENTION

It is the object of the present invention to further enhance decorative effects to maximize the quality of the visual appearance by adding engraved graphical—or textual patterns as effect elements onto the surface of a product, and additionally illuminate distinctive patterns on the same surface.

Primary features obtained by the invention are:

a) A surprisingly graphic decoration with illuminated patterns.

b) Different decorative patterns having light illumination.

c) Enhanced quality of the surface.

A first aspect of the invention is to provide a method for creating a surprisingly attractive display surface, having various characteristics.

A further aspect of the invention is an illuminated surface on a device configured with graphical patterns, where the patterns may include text and/or symbols where the display device is characterized by:

An object in hard material, the object having a front side with one or more marked or engraved patterns;

A back side with light elements;

Light guides connecting the engraved pattern with the back side.

This is achieved by the invention by providing a method according to claim 1 wherein the method of providing a contrast area in a display surface, where said contrast area may contain graphical patterns, text, symbols, geometrical figures or other indications, where said display surface has an aluminum body, said body having a front side which in use is the display side and a rear side, said method comprising the following steps:

a) working the display surface to the desired surface finish;

b) Providing one or more apertures in a desired display pattern, through the aluminum body;

c) anodizing at least the display surface d) sealing the anodized surface, followed by e) laser marking the metal underneath the oxide layer created by the anodizing;

i) following step e) filling the apertures with a resin and hardening said resin.

This method provides the possibility of obtaining a marked surface. A first manner is by creating a dark area by changing the characteristics of the material preferably aluminum such that the amount of light reflected from it will be reduced. In this manner a dark area may be provided. This is created by traversing a laser beam across the display pattern such that the metal at the interface or underneath the interface, i.e. underneath the oxide layer, has changed the material characteristics. Typically by using a laser it is possible to alter the structure of the metal layer at the interface in such a manner that it will turn dark.

The method also provides for the provision of other colours also including dark colours by a dying process where a desired pattern or area of the anodized, unsealed surface is dyed by a desired dye colour. The area may typically be masked off such that a dye is not allowed to transgress into areas which are not desired or designated to be dyed. After having placed or applied the dye, the surface is sealed in order to retain the dye in place in the marked area. In this manner it is possible to create markings, patterns, or areas having distinctive different colours than the surrounding surface.

Naturally, the surrounding surface where the dye was not applied is sealed too and keeps its original appearance.

In a further advantageous embodiment of the invention the surface working in step a) may include milling, turning, grinding, ice, sand or glass blasting or polishing. Depending on the structure and particularly the texture which it is desired to impart to the display surface any of the above mentioned methods may be used. Naturally sand, glass or ice blasting and polishing provides for very smooth surfaces whereas milling and grinding provide slightly more rough or uneven surfaces which may also be desirable for certain applications.

Turning is particularly useful for circular cylindrical objects.

In a still further advantageous embodiment of the method a method step between step a) and step c) is introduced where a thin protecting anodizing layer of between 2 and 6 μm is established, which protective anodizing layer is removed again by etching prior to step c).

The temporary anodizing layer stabilizes the surface sufficiently such that when the apertures are formed for example by laser drilling or laser ablation the material does not erode close to the surface such that very sharp edged and well-defined apertures may be provided. In order to enlarge the holes/apertures the holes may be enlarged by etching, if it is desirable to enlarge the holes.

An advantageous method for forming the apertures in the aluminum body in step B is/are when they are made by laser machining from the rear side of the body. Typically, for displays integrated in a relatively thick material other means for removing part of the material thickness such as for example grinding or milling may be used in order to work the display material thickness down to a relatively low thickness at least in the areas where the apertures are to be established. After having done this pre-thinning the laser machining is applied in order to make the very well-defined and very closely spaced apertures which will provide the desired clear and distinctive pattern on the front side of the display.

In a further advantageous embodiment different method steps of providing the contrasting area is disclosed, where method steps d) and e) are substituted by method steps f), g), h) and i), such that the method comprises the following steps also:

f) dyeing the anodized display surface in a desired pattern or area;

g) sealing the anodized and dyed display surface;

h) cleaning excessive dye from the display surface and i) following step h) filling the apertures with a resin and hardening said resin.

The coloring in step f) is in a still further embodiment applied to the surface by silkscreen printing, inkjet printing or rollers, optionally using masks, paintbrush or airbrush.

Particularly by using silkscreen printing very smooth, even, and colourful layers, areas, or patterns may be obtained an by aligning both the display and the silk screen print very well defined edges/borders of the colored area may be obtained. Also, the types of colour/dye used in the silkscreen printing process may be selected having a very wide range of different characteristics such that substantially any and all desired colours, textures and surfaces may be obtained. Multi-coloured patterns or areas may be obtained by additional silkscreen print steps.

Figure 1:
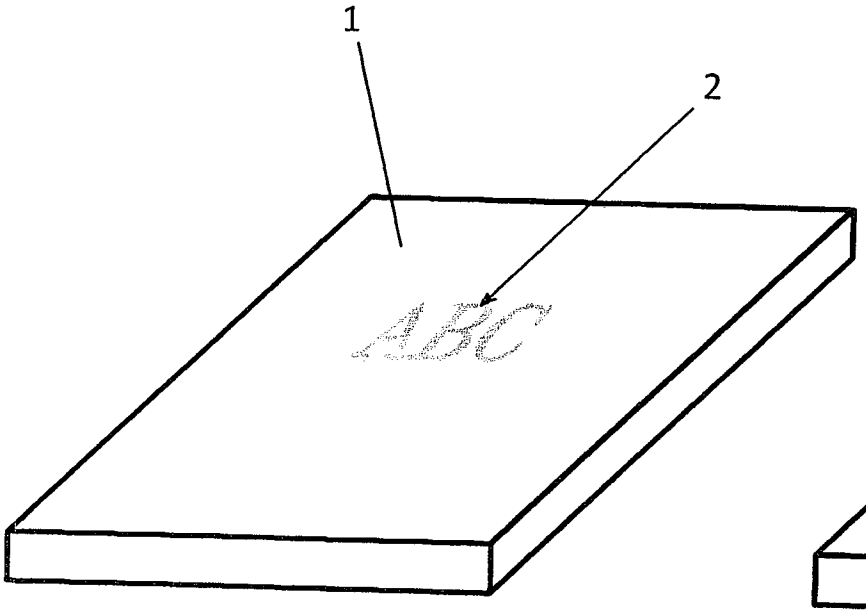
Figure 3:
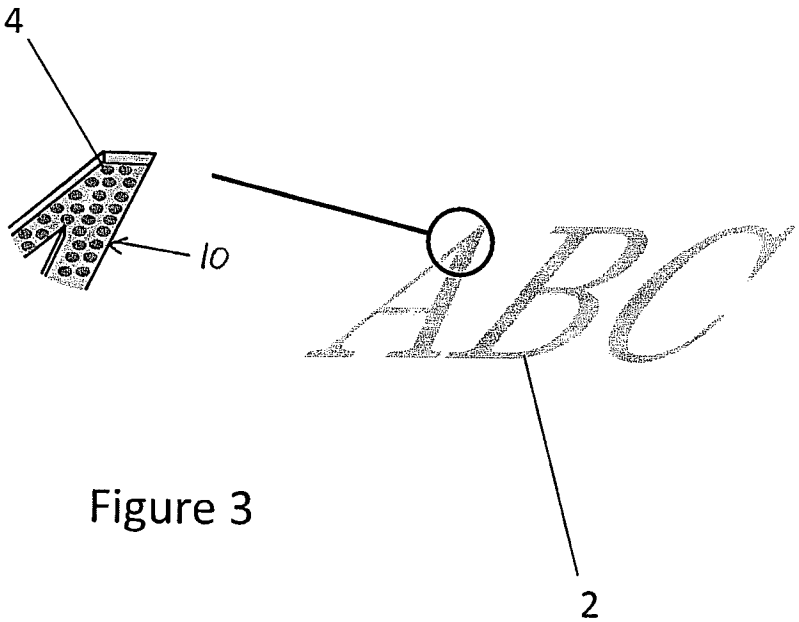
Figure 4:
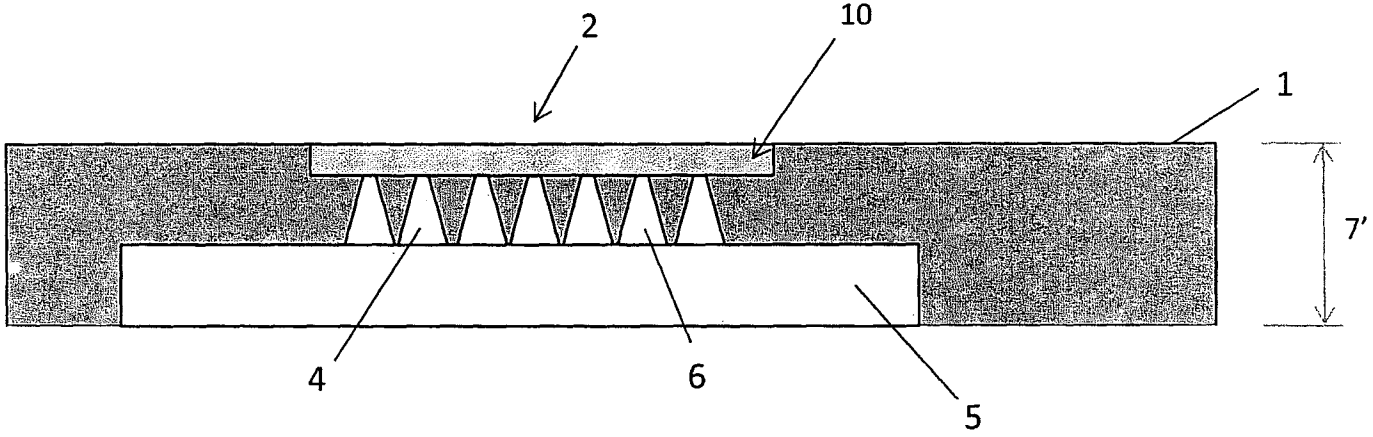
Figure 5:
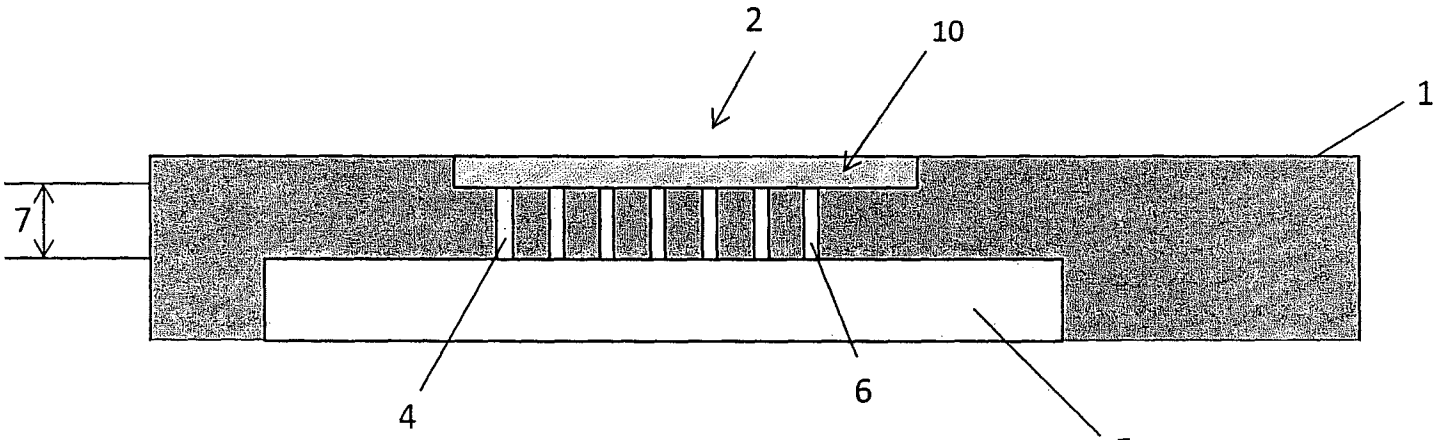
Figure 6:
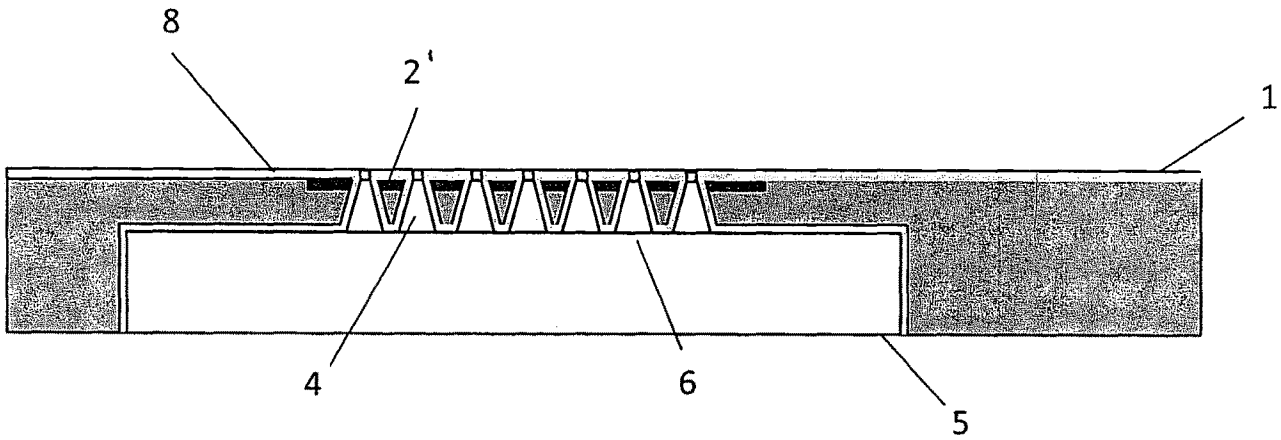
Figure 7:
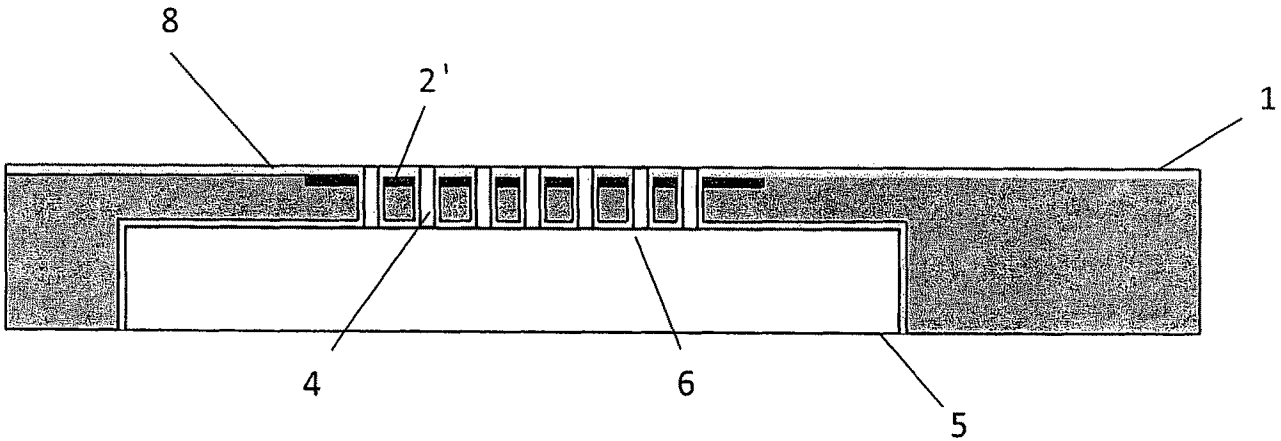
Figure 8:
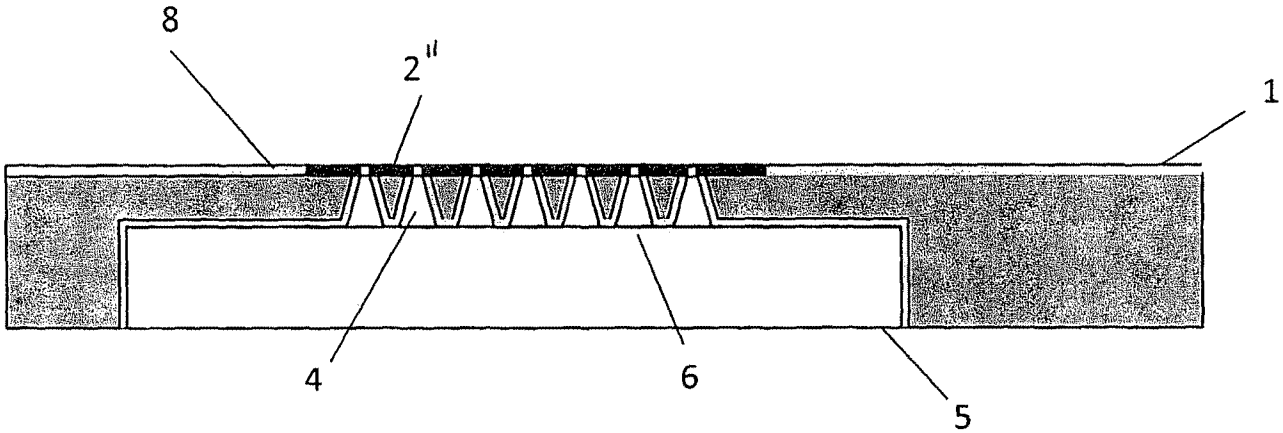
Figure 9:
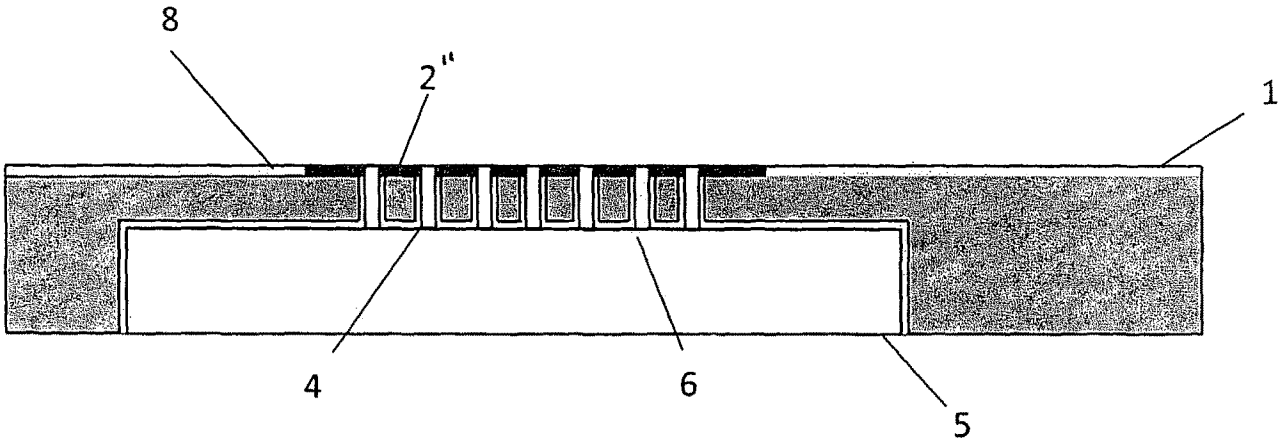
Figure 10:
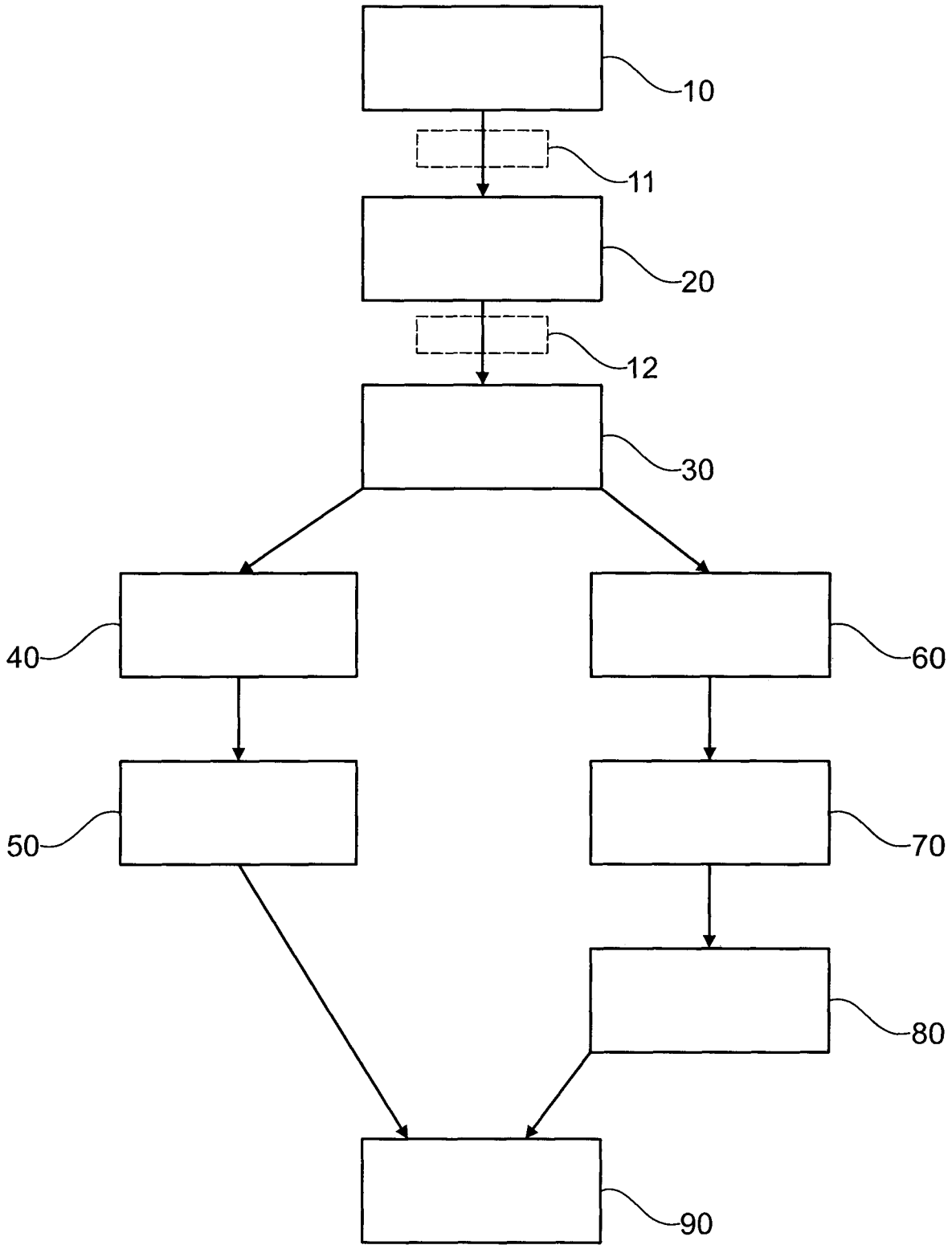

The intention will now be described in more detail with reference to a few embodiments which are illustrated in the accompanying drawing wherein FIG. 1 illustrates an object 1, in this example a display or control panel FIG. 2 illustrates a situation where a light source (not illustrated) is activated behind the display FIG. 3 illustrates the graphical pattern 2 in detail FIG. 4 illustrates a cross section through a display according to the invention FIG. 5 illustrates a cross section through a display according to the invention FIG. 6 illustrates a dark area underneath the oxide layer FIG. 7 illustrates a dark area underneath the oxide layer FIG. 8 illustrates a further embodiment of the invention FIG. 9 illustrates a further embodiment of the invention FIG. 10 illustrates a schematic overview of the method leading to the embodiments described above.

DETAILED DESCRIPTION

The pattern effect is obtained by successive processing steps, each applying standard technologies and methods. Any graphical pattern may be configured on to an object according to any graphical or functional requirements.

In a preferred embodiment of an apparatus applying the disclosed aspect of the invention, functional features may be:

The light is directed from the back side through light guides—small holes drilled through the metal part within a pattern marked or engraved on the front side. The holes become part of the pattern marked or engraved on the surface.

In FIG. 1 is illustrated an object 1, in this example being a display or control panel. A graphical pattern 2 is marked or engraved onto the front surface of the panel 1. Under normal circumstances the marked or engraved pattern 2 will be visible in normal daylight. In FIG. 2 is illustrated a situation where a light source (not illustrated) is activated behind the display 1 such that light illustrated by the arrows 3 beams through apertures provided in the graphical pattern 2 as will be further discussed below.

In this manner even in darkness it is possible to see the graphical pattern 2 clearly in that it is illuminated as illustrated by the light-rays 3.

Turning to FIG. 3 the graphical pattern 2 is shown in detail such that a particular detail indicated by the circle is enlarged in the left hand side of FIG. 3 where the holes 4 are indicated as closely spaced inside the borders/edges 10 of the graphical pattern in this embodiment illustrated by the letters A, B and C. The engraving or marking process will remove a thin material layer, thereby creating the edges 10. By shining light behind the display 1 through the holes 4 light will be emitted as illustrated in FIG. 2 with reference to the light beams 3 illustrating/illuminating the graphical patterns, i.e. the letters A, B and C.

In FIG. 4 is illustrated a cross section through a display according to the present invention. For the sake of good order it should be noticed that the relative dimensions are not true to the dimensions which will be used in real life as for example the apertures/holes 4 will be very, very tiny, as will the material thickness indicated by reference number 7 in FIG. 5 also be relatively thin. However, for illustrative purposes the cross section is very illustrative.

The object 1 is provided with a rear cavity 5 which is created for example by milling or grinding in order to reduce the overall display thickness 7' to the relatively thin thickness 7 in the area where the graphical patterns 2 are to be provided. The edge of the area where a pattern is provided is marked as 10.

In this embodiment the apertures/holes 4 have a conical shape such that a light source arranged in the cavity 5 will be able to shine light through the holes 4 illuminating the surface of the display is indicated in FIG. 2. The apertures 4 are filled with a transparent filler, for example an epoxy, acrylic, or other resin based filler. The graphical marking 2 is provided across the same area as the holes 4. This corresponds to the explanation which was provided above with reference to FIGS. 1 and 2. In this manner a graphical marking is visible in normal light as illustrated in FIG. 1 and an illuminated pattern is visible due to the provision of a back light creating light beams 3 through the holes, as illustrated in FIG. 2.

The main difference between FIGS. 4 and 5 is the fact that in FIG. 5 the holes 4 are cylindrical. Having conically shaped holes 4 as illustrated in FIG. 4 is made possible when using the laser drilling technologies whereas the holes 4 being circular, cylindrical as indicated in FIG. 5 may in addition to laser technology also be provided by other methods.

A specific example is given below with typical values that do not limit the scope of the invention.

In a preferred embodiment standard laser mean is applied to configure the holes:

The laser equipment:

Trumpf Vmc1 laser workstation.

Parameters (settings) used on the laser:

Power 95%, repetition rate 9000 Hz, number of pulses per hole: 6000.

Followed by alkaline etch in sodium hydroxide 50-100 g/l for 3 minutes.

Thickness (7) where the holes are:
0.2 mm-0.5 mm.

The size of the holes (diameter) and distance between holes
Diameter 0.02-0.07 mm on the front side.
Center-center distance 0.1-0.2 mm.
The diameter depends on laser and on etching parameters.

When using laser to configure the holes a preferred embodiment utilizes a standard laser. However, this specific example does give typical values, but should not limit the scope of the invention as other types of lasers and other values are usable within the same method as will be recognized by the skilled person.

As is evident from the parameters above the holes are very tiny and as such a large number of holes may be arranged very closely together and much more densely than indicated in FIG. 3 which are only to be understood as an illustration of the principle of the present invention.

The graphical pattern (2) on top of the surface of the object (1) may be made by engraving, or marking.

The laser equipment may be used for engraving or marking according to the adjustment of the laser tool parameters.

Alternative means to configure the graphical pattern may be mechanical engraving, chemical engraving—selective etching.

According to product requirement the engraving or marking can be made so it appears to have a surface that is smooth, rough, colored, multicolored and alike in any variant.

The invention may be used in all types of equipment and apparatus, where there is a demand for a high quality user interaction surfaces including graphics patterns on the surface, with a very nice looking expression/display.

Examples of equipment are, but not limited to: Consumer electronics, furniture, control panels, loudspeaker grills in cars, boats and airplanes and alike.

Turning now to FIGS. 6 and 7 they in principle illustrate the same method, but vary with respect to the shape of the holes, i.e. the holes in FIG. 6 are conical whereas the holes in FIG. 4 are cylindrical, but otherwise the constructions are very similar.

In FIGS. 6 and 7 the dark area 2', for example indicating the illustrations as illustrated in FIGS. 1 and 2, is created by the following method steps. As was the case with respect to the embodiment of the invention illustrated with reference to FIGS. 4 and 5 the object 1 has been worked in order to provide the cavity 5 such that in the area where the holes 4 are to be provided the material thickness has been made very thin. After having made the holes/apertures 4 in the limited material thickness of the object 1 at least the display surface is anodized. After the anodizing the anodized surface is sealed. After the sealing stage a laser beam is traversed across the surface whereby the metal underneath the oxide layer is altered in order to create the dark area 2'. The term dark area shall in this this context be understood as a texture on the metal-oxide interface which is reluctant to reflect light and as such will absorb light thereby giving a dark/black image or pattern. During the creation of the dark area 2' the oxide layer 8 is maintained complete and as such the laser is controlled such that it will only alter/change the metal at the interface between the oxide layer and the aluminum.

In FIGS. 8 and 9 is illustrated a further embodiment where the only difference between the embodiment illustrated in FIG. 8 and the embodiment illustrated in FIG. 9 is the cross-sectional shape of the holes 4.

The object 1 is again provided with a cavity 5 formed by any of the methods described above such that only a thin material thickness is left in the area where the holes/apertures are to be provided. The surface layer of the object 1 is in the embodiments illustrated in FIGS. 8 and 9 provided with so-called inoxide decoration 2". This is created by applying a dye locally, for example by silkscreen printing onto the anodized surface before the surface is sealed. In this manner the seal will retain the dye inside the anodized layer such that the dye becomes part of the oxide. A very long-lasting surface is thus provided.

Turning to FIG. 10 a schematic overview of the method leading to the embodiments described above is illustrated.

In a first step 10 the surface finish is performed on the object. This may for example be grinding, milling, ice- or sand blasting or glass blasting etc. in order to provide the display surface which is desired for the particular application.

Also, the cavity 5 illustrated in FIGS. 4-9 is performed at this stage. After this method step the following step 20 is to arrange the apertures/holes in the desired pattern, for example as illustrated with reference to FIGS. 1-3 in order to make it possible for a light source arranged on the backside of the display to emit light and shine light beams 3 through the apertures 4. Between the steps 10 and 20 an anodizing step 11 may be introduced in order to stabilize the structure while performing the following steps. This protective anodized layer may be removed before the final anodizing which is to be the finished surface. The apertures will typically have a very small diameter, i.e. 0.02-0.07 mm and may be enlarged for example by etching up to a typical diameter of 0.04-0.05 mm measured on the surface. After having performed the holes/apertures the object is anodized in a further method step 30.

At this time depending on the desired surface marking the object may either be subjected to sealing of the anodized layer in a further method step 40 after the sealing step 40 the surface of the object may be subjected to laser treatment as described above where the metal at the interface between the protective oxide layer and the aluminum as such is altered due to the energy from the laser. This alteration provides a "dark area", i.e. a surface which reflects less light than the surrounding surface and as such will appear dark/black. This happens in a laser treatment step 50 following the sealing step 40. Alternatively, the unsealed anodized object may proceed to a dyeing station 60 where areas to be dyed may be subjected to a silkscreen printing process such that the dye from the silk screen printing process is directed onto the unsealed anodized surface locally where desired.

Following the dyeing step 60 a sealing step 70 is provided such that the dye is sealed into the anodized layer. Following the sealing the object is to be cleaned in a further step 80 such that the object at this point is free from any excess dye. Following both the laser treatment step 50 and the cleaning step 80 is a step where the apertures/holes are filled with a transparent agent such as for example a resin- or acrylic-based agent which is allowed to harden in step 90.

An optional process step is to fill the holes with a translucent sealing:

UV hardening low viscosity resin is applied from the back side while the front side is illuminated by UV light.
The liquid resin soaks through the holes and starts hardening once it reaches the front surface. The surface of the hardening resin may deform and create a micro-lens at the end of each of the holes.
Then the liquid resin is irradiated by UV light also from the back side and the hardening is finished.

If the pattern is turned into an array of micro-lenses, those will aid spread the light shined from the back side.

The material used for an object (1), may be of any "hard" type e.g. but not limited to ceramic, metal (iron, steel, bronze), aluminum, carbon-fiber, stone or any type of plastic and PVC and etc.

In a preferred embodiment the material applied is anodized Aluminum. This requires an optional additional etching and anodizing process.

Thus, the optional process for Aluminum is:

1. Surface finishing
2. Thinning
3. Laser marking of the pattern
4. Laser drilling of the holes
5. Etching (optional, if the holes made by the laser are not wide enough)
6. Anodizing
7. Filling the holes by a transparent resin (optional)

The invention claimed is:

1. A method of providing a contrast area in a display surface, where said contrast area may contain graphical patterns, text, symbols, geometrical figures or other indications, where said display surface has an aluminum body, said body having a front side which in use is the display surface and a rear side, said method comprising the following steps:

a) working the display surface to the desired surface finish;

b) establishing a thin protective anodizing layer of between 2 and 6 μm;

c) providing one or more apertures by a laser machining process, in a desired display pattern, through the aluminum body and the protective anodizing layer;

d) removing the protective anodizing layer established in step b) by etching;

e) after step d), anodizing at least the display surface;

h) dyeing the anodized display surface in a desired pattern or area;

i) sealing the anodized and dyed display surface;

j) cleaning excessive dye from the display surface;

and k) following step h) filling the apertures with a resin or acrylic and hardening said resin or acrylic.

2. The method according to claim 1, wherein the dyeing in step h) is applied to the surface by silkscreen printing, inkjet printing or rollers, optionally using a mask and paintbrush or airbrush.

* * * * *